US006387221B1

(12) United States Patent
Schoenhard

(10) Patent No.: US 6,387,221 B1
(45) Date of Patent: May 14, 2002

(54) PROCESSING METHOD AND SYSTEM TO CONVERT GARBAGE TO OIL

(76) Inventor: James D. Schoenhard, P.O. Box 325, Athens, IL (US) 62613

( * ) Notice: Subject to any disclaimer, the term of this patent is extended or adjusted under 35 U.S.C. 154(b) by 0 days.

(21) Appl. No.: 09/386,726

(22) Filed: Aug. 31, 1999

Related U.S. Application Data

(60) Provisional application No. 60/104,571, filed on Oct. 16, 1998, and provisional application No. 60/090,625, filed on Jun. 25, 1998.

(51) Int. Cl.[7] ..... C10B 51/00; C10B 47/00; C10B 1/00; B10D 3/00; C07C 1/00

(52) U.S. Cl. ..... 201/25; 201/28; 202/106; 202/117; 202/118; 202/110; 202/180; 202/185.1; 585/240

(58) Field of Search ..... 585/240, 241, 585/242; 201/2.5, 25, 28, 29, 33; 202/100, 106, 117, 180, 185.1, 265, 118, 119, 110

(56) References Cited

U.S. PATENT DOCUMENTS 3,939,057 A * 2/1976 Reed, Jr. ..... 208/11
3,995,836 A * 12/1976 Carter et al. ..... 259/6
4,050,991 A * 9/1977 Kautz, Jr. ..... 202/99
4,166,786 A * 9/1979 Duraiswamy et al. .... 208/48 R
4,511,434 A * 4/1985 Vasalos ..... 202/99
4,842,692 A * 6/1989 Baker ..... 201/23
4,842,728 A * 6/1989 Baker ..... 210/180
5,269,947 A * 12/1993 Baskis ..... 210/774
5,360,553 A * 11/1994 Baskis ..... 210/774
5,543,061 A * 8/1996 Baskis ..... 210/774
5,589,599 A * 12/1996 McMullen et al. ..... 585/240
5,611,492 A * 3/1997 Hunt et al. ..... 241/23
5,672,794 A * 9/1997 Northemann ..... 585/241
5,851,361 A * 12/1998 Hogan ..... 202/136

* cited by examiner

*Primary Examiner*—Jerry D. Johnson
*Assistant Examiner*—Alexa A. Doroshenk
(74) *Attorney, Agent, or Firm*—Chapman and Cutler

(57) ABSTRACT

Garbage and waste of all types that includes or comprises organic matter, particularly including medical waste, plastics, paper, food waste, animal by-products, and the like, can be economically recycled into petroleum products, including oil. Machinery performs a method that mimics natural processes but accomplishes the task in minutes, at rates of about 15 tons per day in a typical processing machine, rather than taking hundreds of thousands of years in nature. The process and apparatus of the invention may chop the waste into small pieces, under negative pressure if appropriate, and then pass the waste into first and then second augers for compression and heating. Destructive distillation occurs, in which large molecular weight hydrocarbons and petrochemicals are heated by hot oil passing through the hollow shaft and by circulating hot, dense, hard material, such as steel balls or fragments or hard rock pieces and such, under pressure with steam, to produce low molecular weight hydrocarbons. The volatile hydrocarbons are released through a pressure relief valve, into a column of catalyst material, and then to a heat exchanger, which cools the gases to condensation temperatures of water and oil. Gases remaining, such as methane, are passed to a furnace or other use, and the water and oil are separated. The hot items used to put heat into the compressed material in the first stage auger are retrieved after processing is completed and then reheated and cycled back into the first stage auger.

7 Claims, 2 Drawing Sheets

PROCESSING METHOD AND SYSTEM TO CONVERT GARBAGE TO OIL

CLAIM TO PRIORITY

The priority of the provisional application filed by the present inventor on Oct. 16, 1998, as Ser. No. 60/104,571, which is a continuation in part of a provisional application filed Jun. 25, 1998, as serial No. 60/090,625, is hereby claimed under 35 U.S.C. §120.

FIELD OF THE INVENTION

The present invention relates to destructive distillation processes and hydroprocessing units for converting organic wastes and garbage to oils in a system using pressure and heat, especially indirect heat, to mimic but greatly speed natural conversion processes.

BACKGROUND OF THE ART

Turning garbage economically to oil, like turning lead economically to gold or conducting cold nuclear fusion, is a process long sought but rarely if ever obtained. Baskis of U.S. Pat. Nos. 5,543,061, 5,360,553, and 5,269,947, of Baker U.S. Pat. Nos. 4,636,318, 4,842,692, 4,842,728, and 4,923,604, and of Chen U.S. Pat. Nos. 4,108,730 and 4,175,211, and others are typical of various such efforts. The present inventor has personally worked unsuccessfully for several years, with others, on the Baskis inventions to try actually to perform such a process, before the company doing the development work under license went bankrupt.

Natural processes turn organic material such as plant and animal material to oil or hard coal over, it is believed, hundreds of thousands of years where conditions of pressure, moisture, and temperature are suitable. In modern times, mountains of garbage in landfills are known to give off gases, including methane, as they decompose. Such gases are occasionally gathered and piped for productive uses such as local heating or co-generation of electrical power; otherwise the methane is preferably burned as it escapes through vent pipes from the landfills, to avoid odors and pollution.

Destructive distillation processes are known for the processing and recycling of oils, but none has been successfully applied to converting native organic wastes to oil. Advantages are well known in reducing land fill volumes significantly by diverting or removing and reprocessing organic wastes—just as inorganic iron and other metals, and paper and many plastics are sometimes reprocessed into new metal ingots, paper and paperboard, or plastic materials—although such processes can be elusive economically.

SUMMARY OF THE INVENTION

The object of the present invention is to recycle garbage and organic wastes, including medical waste, into oil in an economical and ecologically sound fashion.

The invention comprises putting bags of waste, or bulk waste, or waste excavated from landfills, through a hopper that feeds to a first auger and then a second auger for compressing and heating the waste. Steam is added to the hopper, and the hopper is under a negative pressure, with exhaust gases going into a safety tank with, for instance, sodium hyperchloride. The exhaust gases also can be treated with ozone or other materials or processes to render them safe before releasing them to the environment. The waste in the hopper may be comminuted by shears or the like, if necessary, before or as it is fed to the first of the heated augers, to improve the processing capabilities and speeds.

Pre-heated, small, solid pieces of inorganic material such as metal balls or hard stones are added to the waste stream in either or both augers to hasten heat transfer into the material and prepare it for treatment. Calcium oxide and/or calcium carbonate may be added to the first auger. The hot material and chemicals help to break and divide the organic material for thorough processing in the first stage and in the second, subsequent autoclave auger stage. Further heat can be added by circulating hot oil through the hollow center cores of the augers.

Steam or hot oil can be added to the first auger for disinfecting raw waste and in an emergency, as, if the auger shaft fails during operation. Steam is also added to the end of the autoclave stage to carry off vaporized volatile components before the balance is passed through a double lock valve and then conveyed to a furnace for combustion. The volatile components are passed through a control valve and a catalyst and then to a condenser for cooling, pressure reduction, and to reduce the oil and water vapor therein to liquid. Remaining gas is fed to the furnace to aid in combustion there. Oil and water are separated after the condenser stage and sent for further processing, as refining and cleaning, or the oil can be used as a heat source in the process.

Heat from the furnace provides much of the energy needed to drive the thermal decomposition of the material in the first and second augers. This heat chiefly goes into the inorganic materials, which then provides a major source of heat for the process. Auxiliary heat supplies of oil, electric, gas, or the like, are also provided to the silo and to the furnace for start-up and when the heat content of the material in the system is insufficient to sustain the reaction processes. Auxiliary heat also is provided by hot oil passing through the hollow shafts of the augers.

Char and inorganic material from the second auger are passed through valves and heated in a furnace, where it is exposed to air for combustion. The material is then dropped onto a vibrating, inclined screen, which separates the material and allows retrieval of the hot metal balls or rocks. Those balls or rocks are then conveyed to a silo and further heated as necessary and then passed back into the first and second stage augers of the system. This system works well with potentially infectious medical waste (PIMW) and all other types of organic materials as to which proper disposition, as well as retrieval of oil contained therein, is critical.

THE PREFERRED EMBODIMENTS

A processor constructed in accordance with this invention may be used to process a variety of organic and mixed materials. The following is a typical embodiment for organic waste.

Figure 1:
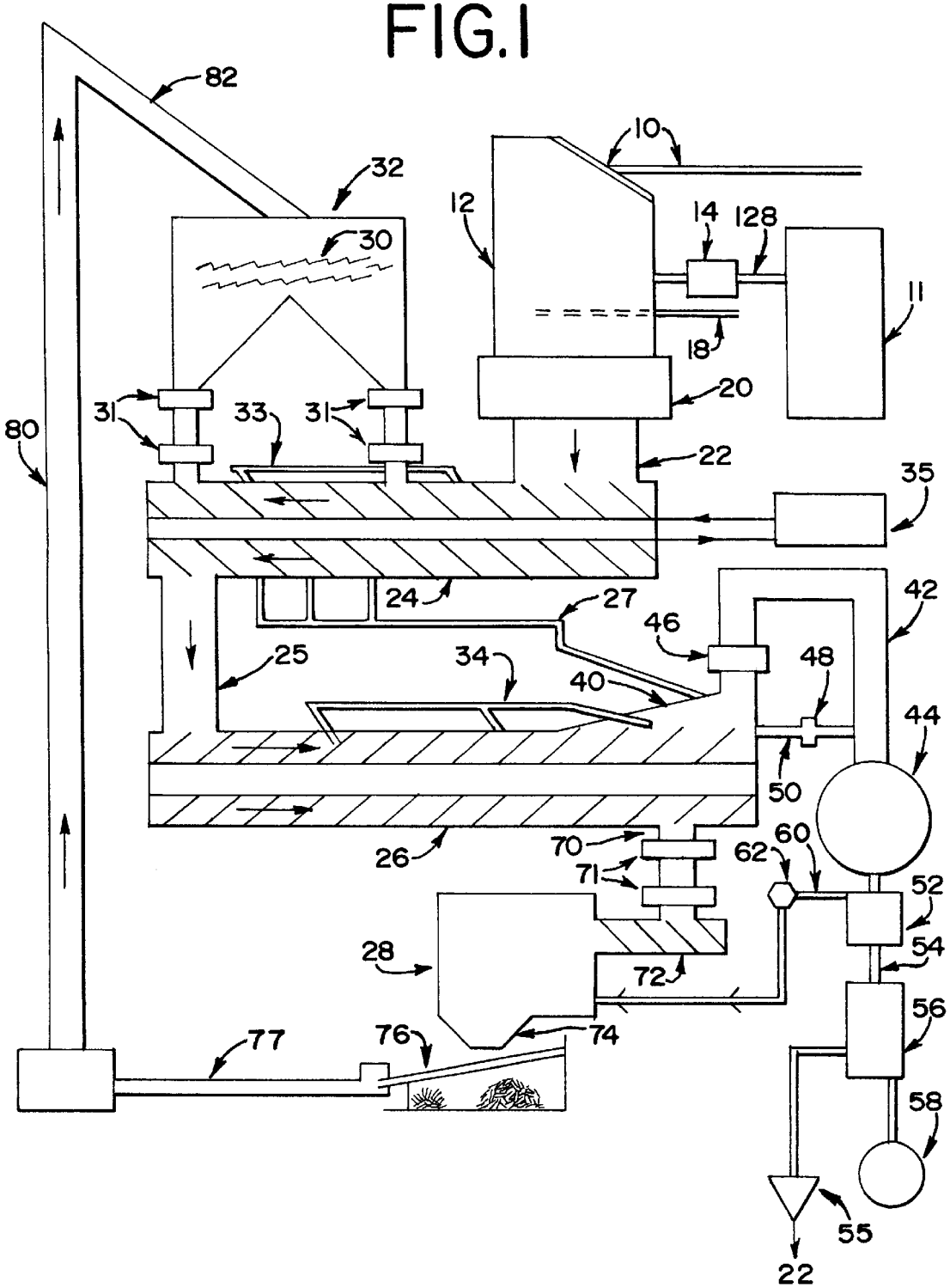
FIG. 1 is a diagram of the major steps and units in the processing of organic waste to oil according to the present invention.

As shown in FIG. 1, process material is loaded from a conveyor belt 10 into a hopper 12. The hopper 12 has a closing lid or similar arrangement for limiting free admission of air, particularly if air contamination may be a concern. A blower 14 establishes a negative air pressure within the hopper and propels the gases from the hopper 12 through a line 128 into a tank 11 filled with chlorinated water. When air contamination is anticipated, steam or hot oil at 250 degrees F. is directed through a line 18 against and into the process material and calcium oxide (CaO) and/or calcium carbonate ($CaCO_3$) is added as it is fed from hopper 12 into a shredder 20. The process material is reduced in size in the shredder 20 to less than about ¾-inch dimensions. Such a shedder is not necessary in all applications, such as when the sole process material is loosely distributed PIMW that can be reduced to soft plastic material in the autoclave feed conveyor, as in FIG. 2.

The comminuted, reduced-in-size process material then fills a second hopper 22, which feeds into an auger unit 24. This first auger is partially heated by passing hot oil through the 6-inch hollow center shaft from oil heater 35. Steam or hot oil through pipe 33 may be added to the waste material in auger unit 24 to sanitize the material, particularly PIMW, in case of an operating failure. This auger 24 compresses and shreds the material, and acts as a pressure regulator, as the process material passes through second hopper 25 and discharges into downstream autoclave auger 26. The calcium oxide or the calcium carbonate helps to break down the structural integrity of paper products in auger 24.

Very hot, solid pieces of inorganic material heated to a temperature of from 300 degrees F. to 1500 degrees F. by a furnace 28 and an inorganic particle heater 30 are stored in a silo 32. The inorganic material pieces are made up of igneous, metamorphic, or sedimentary rock material, or any solid metal or metal compound whose melting point is above 1500 degrees F. Zeolite material may also be used, or a combination of rock or metal and zeolite. Sizing of material can vary from 3 inches to ⅛ inch in diameter. For this particular application, the maximum size should be about 1 inch, and the minimum size about ⅛-inch. The hardness of rocks used should be between 2.5 and 9 on Mho's Hardness Scale. This hot material is discharged from the silo 32, through a double lock valve 31, into the first, feed auger 24 with the process material compressed there. The hot material further heats, softens, and vaporizes the waste and creates gas pressure, which is relieved through line 27 into vapor space 40. The hot solids continue to heat and vaporize the waste. Autoclave 26 can also be heated through its hollow, 6-inch shaft by hot oil from heater 35 (connection not shown). Process material travels through autoclave 26 by way of a spiral or paddle horizontal shaft conveyor, at a rate of 1 to 3 feet per minute, driven by a variable speed motor (not shown). This process allows the complete and uniform heating of all organic matter and kills all pathogens in the waste stream.

The operating temperature of the autoclave 26 and the adjacent part of feed augur 24 is 250 degrees F. to 1500 degrees F., and ideally, it is about 650 degrees F. The operating pressure in autoclave 26 and part of feed augur 24 is between 29 PSIG and 600 PSIG, and ideally is about 60 PSIG. All of the heat can be supplied by the heated pieces of inorganic material from silo 32. During the compression and heating process, the organic material in the process stream is subjected to destructive distillation, which produces a mixture of hydrocarbon gases. Steam is fed into the downstream stages of the autoclave 26, via a line 34, to mix with the emitted gases to help reduce heavy oil and tar constituents and to add further heat to the distillation reaction.

The hydrocarbon gases and steam rise up into a vapor space 40 and go through a catalyst-packed pipe 42, which can reform some volatile organics, and to a heat exchange unit 44. The gas pressure through pipe 42 is contained by a control valve 46, which limits the pressure of gas leaving autoclave 26. A relief valve 48 in by-pass pipe 50 is set at a slightly higher pressure than the ideal pressure for autoclave 26 and would activate if allowable pressure in the autoclave 26 is exceeded. The heat exchanger 44 quickly removes excess heat from the hot gases, cooling the gases within a few seconds of entry so that condensation will occur. The remaining gases and liquids flow to a downstream expansion tank 52, providing therein liquid water, liquid oil, and light gases such as methane. The liquids pass through a bottom outlet and pipe 54 to an oil/water separation reservoir 56. The oil flows into a tank 58. The light gases pass from a gas outlet 60 to a scrubber 62 and then to help fuel the furnace 28.

Operating the autoclave 26 at different temperatures and pressures will vary the percentages of liquid and gas produced. If lightweight, volatile liquids were desired as an output product, then a fractional distillation unit would be used to replace the expansion tank 52 through oil storage tank 58. This oil may be refined or also used for furnace fuel as needed. Water from the oil/water separator 56 is treated to remove unwanted minerals and dissolved solids at water treatment unit 55. It is then heated and pumped to a hopper 22 to be recirculated with other waste.

Char, ash, and the hot inorganic pieces are removed from autoclave 26 through a further hopper 70, which has a double lock valve 71 and a further auger 72. Auger 72 feeds char, ash, and inert material to furnace 28, where the char is burned to produce heat. The temperature of autoclave 26 can be controlled by the temperature of the inorganic solid pieces heated by furnace 28 and heater 30 in silo 32.

Ash and inorganic material pieces leave furnace 28 through hopper 74 and fall upon an inclined double deck vibrator screen 76. The ash and small pieces of inorganic material fall through the screen 76 into individual piles. The larger pieces of hot inorganic solids drop onto conveyor 77 and are lifted by conveyor 80, which raises the inorganic solids to chute 82, where they then pass into the insulated storage and heating silo 32. This silo 32 provides the immediate supply of heated inorganic material at a correct temperature for the auger 24 and the autoclave 26 at start up and during operations.

Figure 2:
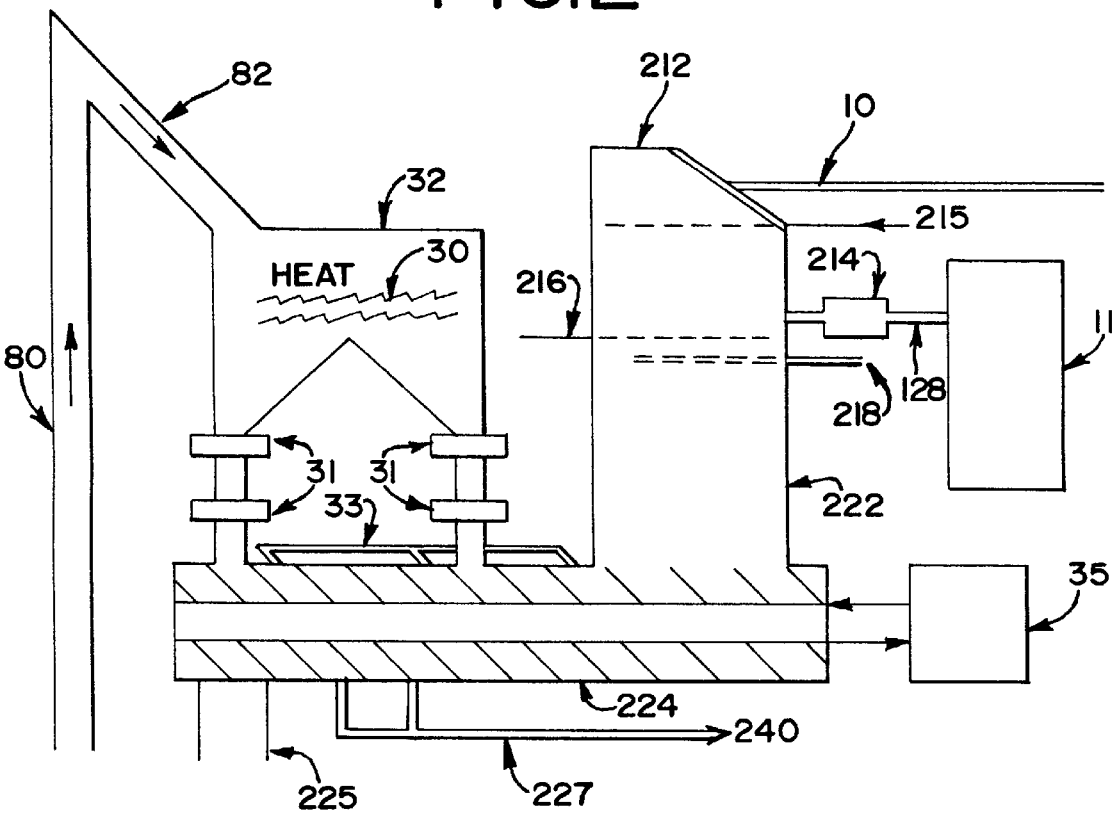
FIG. 2 is a diagram of the input stage and first auger of a form of the invention specific to potentially infectious medical waste (PIMW).

FIG. 2 shows an alternative loading hopper 212 that can be used for PIMW without shears. Bags or packages of PIMW are put into hopper 212 when a first floor gate 215 is opened. After the first gate 215 is closed, a second floor gate 216 can open. Steam or hot oil from pipe 218 blows into the hopper 212 as the material drops through chute 222 and into the auger unit 224. The floor gate 216 then closes, and the blower 214 then evacuates air between the floor gates in the hopper 212, at which time the first floor gate 215 may open for another bag of waste material. Other parts correspond to those of FIG. 1 with corresponding numbers, with similar operations.

Other forms of equipment may be used without departing from the principles of the invention. Many variations may be made in the invention as shown and in its manner of use, without departing from the principles of the invention as pictured and described herein and claimed as my invention. Minor variations will not avoid the use of the invention.

What is claimed is:

1. A method of recycling waste organic materials into oil in a closed system, wherein the method comprises the steps of:

passing the waste materials through first and second augers and heating and compressing them at a temperature of at least about 250° F. and at a pressure of at least about 29 PSIG and of up to about 1500° F. and 600 PSIG, injecting steam into the compressed and heated materials at the end of the second auger stage to drive off volatile gases from the charred residue of the materials within the closed system;

passing the steam and gases through a catalyst that helps reform the gases to useable hydrocarbon products and water vapor; and condensing and separating the products and vapor to oil, water, and light gases.

2. The recycling method of claim 1, further comprising the step of mixing hot inorganic material with the waste material in the first auger, the inorganic material having object sizes of between about ⅛ inch and about 1 inch and a temperature when put into the first auger of between about 300° F. and about 1500° F.

3. The recycling method of claim 1, wherein the pressure and temperature of the auger stages are varied to provide selectively one of heavy and light hydrocarbons as products of the process.

4. An organic waste recycling and oil production system comprising:

a hopper for accepting a stream of waste organic materials, the hopper having an outlet;

a first auger receiving said stream of waste organic materials from said hopper outlet, the auger being turned and having a shaft along the turning axis and means to compress and to heat the materials and vane means passing the materials along the shaft of the auger as said auger turns;

a second auger receiving the compressed and heated materials from the first auger and further compressing and heating the materials and moving them along the auger as it turns;

a steam injection port at a downstream end of the second auger, wherein steam injected through said port drives off volatile hydrocarbons from the compressed and heated materials;

a catalyst receiving the steam and hydrocarbons from the second auger and distilling the hydrocarbons to lighter forms of same; and a condenser receiving the hydrocarbons from the catalyst and liquefying same for recovery and reuse.

5. The system of claim 4, further comprising a volume of hot inorganic materials for injection into the stream of organic materials for heating the materials during the processing in the first and second augers.

6. The system of claim 4, wherein the hopper is closed and is maintained under sub-atmospheric pressure.

7. The system of claim 6, wherein gases sucked from the hopper are passed through a cleansing solution to atmosphere.

* * * * *